United States Patent [19]

Woolley

[11] Patent Number: 4,571,579

[45] Date of Patent: Feb. 18, 1986

[54] SWIMMING POOL ALARM

[76] Inventor: Edward N. Woolley, 6 Holloway Rd., Islington, Ontario, Canada, M9A 1E8

[21] Appl. No.: 579,576

[22] Filed: Feb. 13, 1984

[51] Int. Cl.[4] ..... G08B 13/00

[52] U.S. Cl. ..... 340/566; 367/136; 367/162; 367/166; 367/157

[58] Field of Search ..... 340/566, 603, 606, 611, 340/626; 367/136, 157, 162, 166, 160-161; 84/DIG. 24

[56] References Cited

U.S. PATENT DOCUMENTS

| | | | |
|---|---|---|---|
| 2,423,459 | 7/1947 | Mason | 367/157 X |
| 2,659,829 | 11/1953 | Baerwald | 367/160 X |
| 2,741,754 | 4/1956 | Miller | 367/162 |
| 2,832,915 | 4/1958 | McCoy | 340/566 X |
| 2,942,247 | 6/1960 | Lienau et al. | 340/566 X |
| 3,192,470 | 6/1965 | Wadey | 340/606 |
| 3,681,750 | 8/1972 | Larka | 340/566 X |
| 3,810,146 | 5/1974 | Lieb | 340/573 X |
| 3,969,712 | 7/1976 | Butman et al. | 367/136 |
| 4,013,992 | 3/1977 | Dewberry et al. | 367/161 |
| 4,170,769 | 10/1979 | Morris et al. | 340/566 X |
| 4,187,502 | 2/1980 | Beverly et al. | 340/566 |
| 4,322,714 | 3/1982 | Morgan | 340/566 X |
| 4,490,640 | 12/1984 | Honda | 367/157 X |

*Primary Examiner*—James L. Rowland
*Assistant Examiner*—Thomas J. Mullen, Jr.
*Attorney, Agent, or Firm*—Ridout & Maybee

[57] ABSTRACT

A swimming pool alarm consists of a sensor suspended beneath the water surface of the pool, including an electrical resonator element and a captive element agitatable by the pool water adjacent the resonator element, and an alarm device external of the pool which responds to the amplitude of resonance of the resonator element exceeding a certain level.

9 Claims, 5 Drawing Figures

SWIMMING POOL ALARM

FIELD OF THE INVENTION

Figure 1:
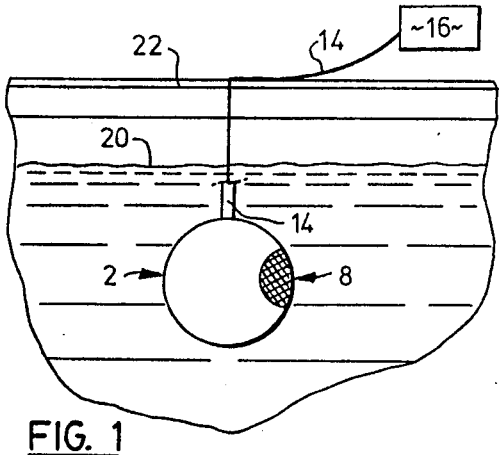

This invention relates to swimming pool alarms intended to provide warning should a person or domestic pet fall into an unattended swimming pool, or in the event of use of the pool by unauthorized persons.

BACKGROUND OF THE INVENTION AND REVIEW OF THE PRIOR ART

A very large number of different forms of swimming pool alarm have been proposed, and a large number of different alarms have actually been marketed. However, to the best of applicant's knowledge, none of these devices has been entirely satisfactory, the major problem being to provide sufficient sensitivity to trigger the alarm whenever it should be triggered without incurring a large number of false alarms. Whilst from the point of view of demonstration, a high sensitivity to water disturbance is impressive, in practical use it is an unmitigated nuisance unless accompanied by some ability to discriminate between disturbances which require investigation, and those which do not, such as wind disturbances, low flying aircraft, and the impact of twigs and other small objects.

Most of the alarms proposed to date have fallen into three main classes, according to the nature of the alarm transducer. In a first class of alarm, exemplified by the alarms of U.S. Pat. Nos. 3,778,803, 3,475,746, 3,683,353 and 2,723,398, the transducer is essentially wave responsive, triggering the alarm a predetermined magnitude. There are various ways in which such devices may be falsely triggered, but their principal failing is that ripples quite large enough to trigger the alarm can readily be generated by wind.

A second class of alarm discussed at column 1, lines 22–36 and 52–60 of U.S. Pat. No. 3,778,803 is triggered by some form of hydrophone. The problem with this type of alarm is that it can be triggered by loud noises external to the pool, such as low flying aircraft.

A third class of alarm has a pressure sensitive transducer exemplified by the alarm of U.S. Pat. No. 2,935,582 which responds to pressure effects in the water. However, this type of alarm again is too readily set off by minor water disturresponse to a small child or domestic pet struggling in the water.

The object of the present invention is to provide a swimming pool alarm which can provide adequate sensitivity combined with a reduced susceptibility to false alarms.

SUMMARY OF THE INVENTION

According to the invention, a swimming pool alarm comprises a transducer head submersible in the water of the pool and incorporating a high Q preferably piezoelectric, resonator element having an ultrasonic resonant frequency, and means sensitive to the amplitude of the resonance of the element and operative to trigger the alarm. Preferably the resonator element is housed in a cavity in the transducer head in free communication with the water in which the head is submerged, the cavity preferably itself being resonant when filled with water, at a frequency approximately the same of that of the resonator element. Preferably also the cavity encloses a moveable element freely agitatable in response to the movement of water in the cavity.

Further features of the invention will be apparent from the following description of a preferred embodiment of the invention.

SHORT DESCRIPTION OF THE DRAWINGS

Figure 2:
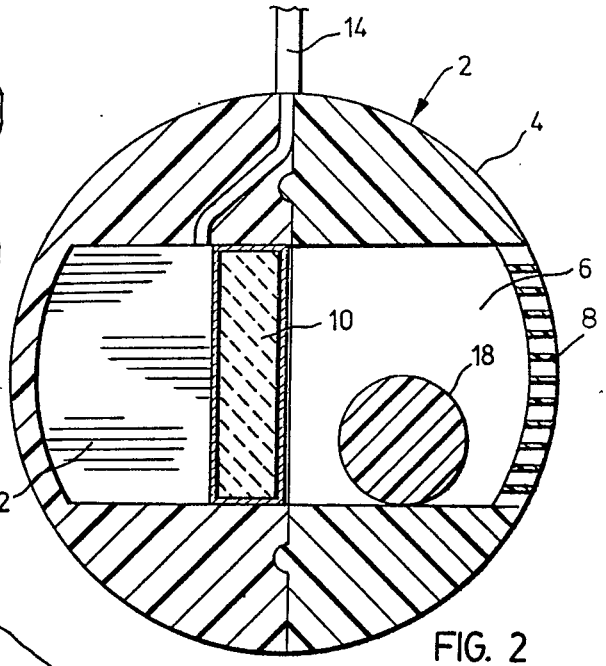
Figure 4:
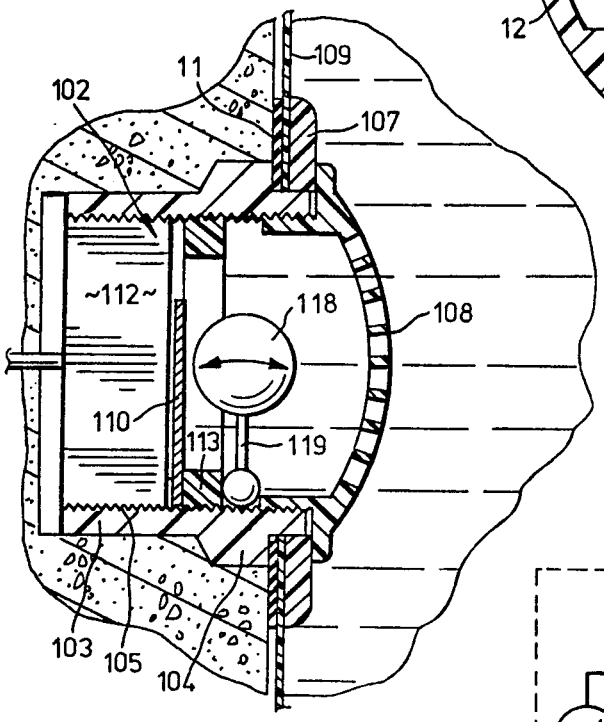
Figure 3:
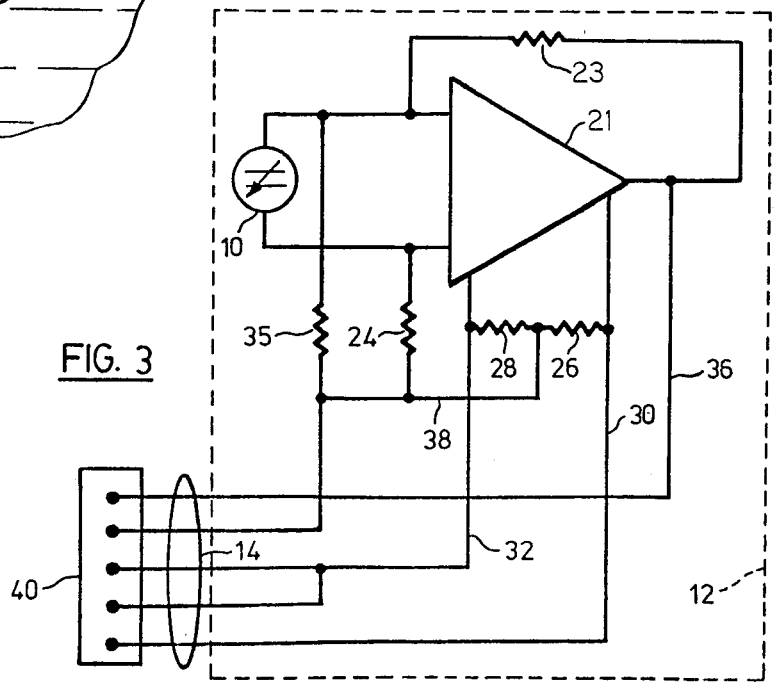
Figure 5:
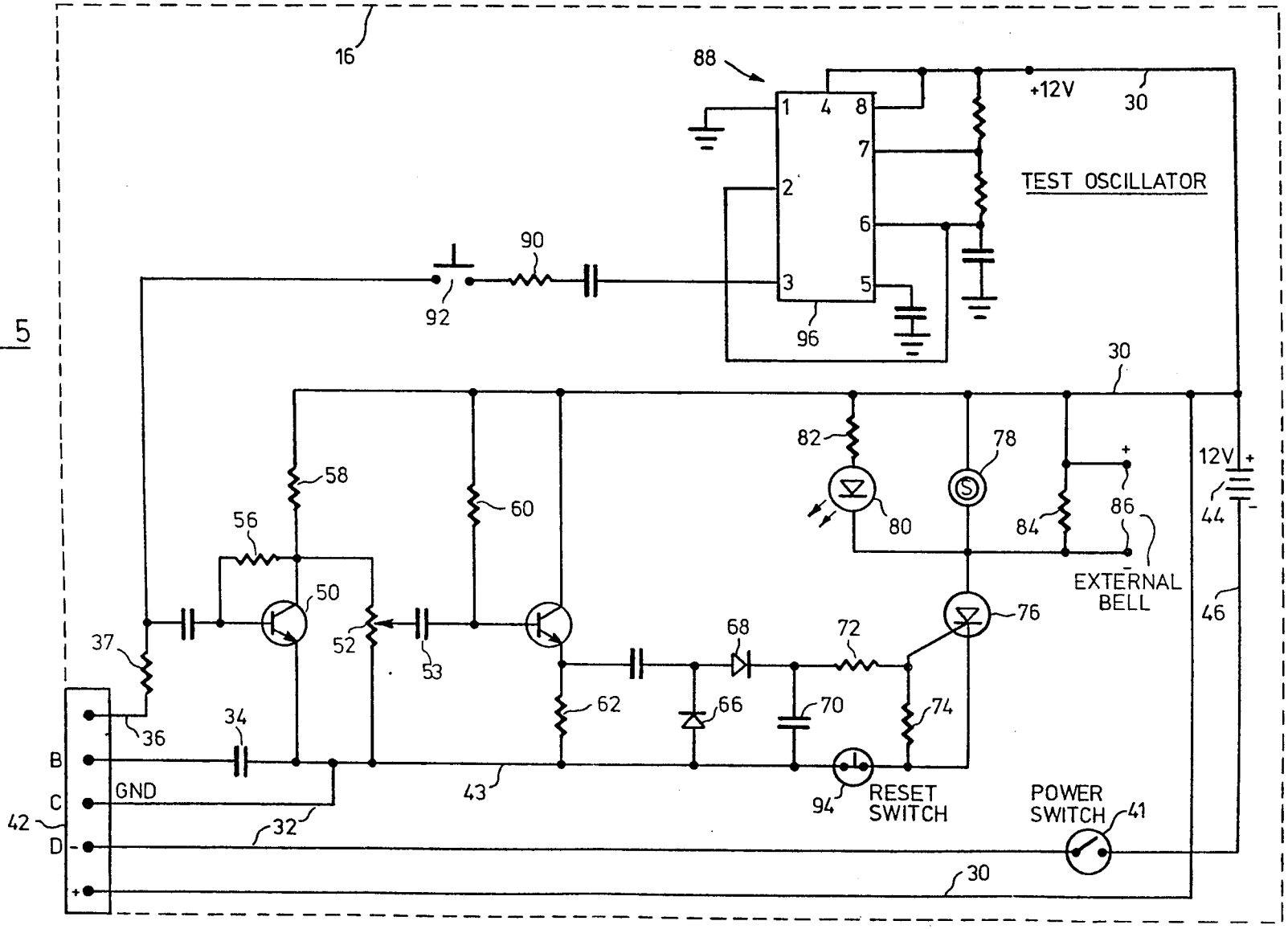

FIG. 1 is an elevation of the transducer unit used in a preferred embodiment of the invention, FIG. 2 is a vertical section through the transducer unit, FIG. 3 is a schematic diagram of the electronic circuit of the transducer head, FIG. 4 is a vertical section through an alternative form of transducer head, and FIG. 5 is a schematic diagram of the electronic circuit of a control unit used in conjunction with the transducer head, Referring to FIGS. 1 and 2, the tranducer head 2 is externally spherical and comprises two generally hemispherical synthetic plastics mouldings glued or welded together. The front moulding 4 defines a cylindrical cavity 6 communicating with the external spherical surface of the moulding through a grille 8 formed in the moulding. The rear moulding is moulded around a transducer 10, a preamplifier unit 12, and a five conductor flexible cable 14 which serves both to connect the transducer head 2 to a control box 16 and suspend the transducer head 2 in the pool. A moulded plastic ball 18 is captive within the cavity 1. The plastic used for the mouldings should have a density significantly greater than unity so that the head hangs down beneath the water level 20 of the pool when suspended by the cord 14 over the coping 22 of the pool. It should also be water impermeable and capable of being moulded at a temperature low enough to avoid thermal damage to the transducer 10 or preamplifier unit 12.

The transducer 10 is a high Q piezoelectric resonator element. This is in contradistinction to the usual types of piezoelectric transducer element, such as the crystal or ceramic microphone inserts which have been used in hydrophone type alarms, in which resonances of the piezoelectric element are critically damped so as to provide a broad frequency response and a reasonably accurate reproduction of the input. The resonant frequency of the resonator is ultrasonic and in practice commercially available resonators of reasonable physical size and reasonably robust construction do have such a resonant frequency, which is preferably in the range 40 KHz to 200 KHz. Sonic frequencies should normally be avoided because then there is the possibilty of a significant ambient noise component at the resonant frequency which might cause a false alarm. The magnitude of such ambient noise components falls as the frequency rises.

The resonator does not act simply as a hydrophone, as do the transducers in many known alarm systems. Instead, it "rings" in response to any frequency component of incident pressure waves which is at its resonant frequency, and if the rate of energy input is greater than the losses due to the inevitably finite Q of the resonator, the amplitude of the ringing will increase. Since the resonator is of piezoelectric material, the ringing will result in the appearance of an alternating electrical potential across the resonator in proportion to the amplitude of the ringing. The transducer will be relatively insensitive to all other non resonant frequencies, thus greatly reducing the risk of false alarms.

We have found that when an object falls into a swimming pool, the impact with the water surface produces a shock wave having a broad frequency spectrum extending well into the ultrasonic region and thus an ultrasonic resonator such as has been discussed will produce a marked "ring" in response to such an impact, the ring having in the case of any reasonably sized object an amplitude well in excess of the amplitude which could be maintained by anticipated ambient noise conditions at ultrasonic frequencies. Thus such "rings" can be detected when they exceed a desired level corresponding to an impact of a particular severity with the pool surface, but with a much reduced likelihood of false alarms.

Response to impacts with the pool surface does not on its own give all the protection desirable. A person or animal could enter the water quite gently without generating substantial shock waves, and thereafter struggle in the water producing water movements again without substantial shock waves, particularly if the victim is entirely submerged. It is found however the the presence of the ba11 18, or some other element, freely agitatable within a cavity adjacent the resonator to which the pool water has free access, induces pressure wave components at the frequency of the resonator element sufficient to cause a build up in the amplitude of the "ringing" of the element; the amplitude build-ups produced by sustained water disturbances due to persons or animals such as cats or dogs swimming or struggling in the water are comparable to the peak amplitudes produced by the impact of the same persons or animals falling into the pool. We have found that provided that the transducer head is suspended well below the surface of the pool, wind-generated ripples on the surface of the pool do not produce any significant transducer response.

It will therefore be understood from the foregoing that the transducer head is highly responsive to events in the pool which it is desired to detect, whilst relatively unresponsive to ambient noise and surface ripples which might otherwise cause alarms. In practice, the resonator element itself is preferably a piezoelectric ceramic plate metallized on both surfaces to provide electrical terminals and encapsulated in a plastic film to protect it from the water. The resonator element used in the embodiment of FIGS. 1 and 2 is of barium titanate, treated during manufacture to give it axial piezoelectric properties, has a diameter of 2 inches and a thickness of 0.5 inch, and has an axial resonance mode at a nominal frequency somewhere in the range 89–96 KHz, although this will be somewhat modified by the mounting of the resonator element with the front surface of its encapsulation exposed to the water and the rear surface sealed to the preamplifier unit 12 which is encapsulated in epoxy resin. At such a frequency, the wavelength of sound in water is about two thirds of an inch, and it is believed important in producing the desired response of the resonator element that the cavity 6 itself has at least one resonance mode, when filled with water, at a frequency close to that of the resonator element. To this end the distance between the transducer 10 and the grille 8 is preferably a small integral number of wavelengths so that the cavity has a longitudinal resonance mode at the same frequency as the resonator element, thus increasing the responsivity of the element. In the preferred embodiment, the distance in question is about two wavelengths; because of the proportions of the cavity, its resonances will not be very sharp and therefore the dimensions are not particularly critical; however, the movement of water past the entrance to the resonant cavity will tend to induce standing waves in the cavity which will act on the resonator element. The ball 18 is believed to act in a similar manner to the pith ball used in some types of whistle to increase the amplitude of the resonance produced, and encourage resonance modes at harmonics of the fundamental resonance of the cavity, the resonator element in the present example being responsive to the second harmonic.

The preamplifier unit 12 shown in FIG. 3 not only increases the electrical noise immunity of the system by amplifying the output of the transducer before it is applied to the cable 14, but presents an impedance to the transducer which introduces just such a degree of electrical damping as is required to adjust the effective Q of the transducer to a desired value. Capacitative loading of the transducer by the cable 14 is also prevented by the preamplifier, which comprises a conventional integrated circuit operational amplifier 21 such as the industry standard 741, operated in inverting configuration with its gain determined by feedback from the output line 36 of the amplifier through the high value resistor 23. The non-inverting input of the amplifier is grounded through the resistor 24 to a ground line 38 whose potential is established by the potentiometer formed by resistors 26 and 28 and extending between positive and negative supply lines 30 and 32, the ground line being grounded in respect of alternating currents by a decoupling capacitor 34 in the control box 16. A further resistor 35 of the same value as resistor 24 loads the inverting input of the amplifier, the value of the two resistors being used to adjust the load on the transducer 10. The lines 30, 32, 36, 38 pass through the cable 14 to a plug 40, the line 32 being duplicated for a reason discussed below.

The plug 40 is plugged into a socket 42 in the control box 16 shown in FIG. 5, so that the duplicated negative supply lines 32 complete a circuit between a switch 41 and a ground line 43 which is a a.c. coupled to the ground line 38 by the capacitor 34. The switch 41 is connected to the negative terminal of a battery 44 via a line 46. This arrangement ensures that the control unit cannot be powered unless the transducer head is plugged in, and also helps to prevent hum pickup in the cable 14. The positive terminal of the battery is connected to the positive supply line 30.

The output line 36 is coupled by a resistor 37 and a d.c. blocking capacitor 48 to a conventional common emitter amplifier stage comprising an NPN transistor 50, a bias resistor 56 and a collector load resistor 58, and a portion of the output of this stage is tapped by means of a variable potentiometer 52 and applied via a coupling capacitor 53 to an impedance converter stage comprising the transistor 54 connected in emitter follower configuration using a bias resistor 60 and an emitter resistor 62. The output of the emitter follower is applied via a capacitor 64 to a voltage doubling rectifier comprising the diodes 66 and 68, the rectifier output charging a reservoir capacitor 70 whence it is applied through a potentiometer comprising the resistors 72, 74 to the gate of a thyristor 76 having an anode load comprising a siren 78, an indicator light comprising a light emitting diode 80 and a series resistor 82, and a resistor 84 to ensure continuity of the necessary holding current to keep the thyristor turned on during operation of the siren. Terminals 86 are provided for the connection of an additional external alarm bell. The alarm may be reset by interrupting the cathode circuit of the thyristor by means of a normally closed switch 94.

To enable testing of the system other than by installing the transducer and disturbing the pool, a test oscillator 88 is provided designed to provide an output at approximately the resonant frequency of the transducer 10, its output being suitably attenuated by a resistor 90 and applied via a press-button test switch 92 to the junction of resistor 37 and capacitor 48. The test oscillator may be a conventional oscillator built around a 555 timer integrated circuit 96 as shown. Other facilities such as a battery state indicator may be included if desired.

In use, the transducer head is suspended in the water of the pool to be protected as shown in FIG. 1, the plug 40 is inserted in the socket 42, the switch 40 is turned on, the function of the control box is tested by pressing the switch 92 to sound the alarm and then the switch 94 to reset it, and the sensitivity of the alarm is adjusted by means of the potentiometer 52, the alarm being reset as necessary by means of the switch 94.

As described, the alarm will trigger at the same level of resonator output amplitude, whether caused by a sudden impact upon the water causing an immediate high amplitude resonance, or sustained water movement, in which case the required level of amplitude will be built up more or less gradually. The relative sensitivity of the alarm to the two types of disturbance may be further enhanced and controlled by partially integrating the signal from the transducer so that the alarm can be triggered by either a brief high amplitude resonance or a sustained resonance of lower amplitude.

It will be understood that whilst a high effective transducer Q is necessary to the proper operation of the invention, an excessively high Q is also undesirable since this will again result in an excessive tendency to false alarms. Suitable values of Q may readily be determined by experiment, by altering the electrical loading on the transducer. It would also be possible to utilize a low Q or non-resonant transducer in conjunction with a high Q or regenerative tuned amplifier in order to simulate a high Q transducer. Resonant element other than piezoelectric elements could be utilized provided that they combine a suitable resonant frequency with high Q when in contact with water, and can provide or be associated with a suitable transducer function. Piezoelectric elements have the advantage of being their own transducers, and providing suitable resonant frequencies and a high Q in elements of convenient physical size and reasonable robustness.

As further refinements, the alarm may be arranged so as to operate for only a limited period following triggering, so limiting the nuisance due to a false alarm in the absence of trigger in response to low battery voltage, so as to warn of the latter, and it will be understood that the unit may be operated from a main supply by use of a separate or built in power supply provided that appropriate safety precautions are taken to protect pool users against electric shock.

An alternative form of transducer head 102 is shown in FIG. 4, this being intended for permanent installation in a pool, normally during its construction. A generally tubular body 103 is housed in a recess in the side of the pool and has an external ring flange 104 and an internal thread 105. A grille 108 screws into the front of the thread 105 and tightens a further flange ring 107 against the liner 109 of the pool and a gasket 11 supported by the flange ring 104. A module comprising a potted preamplifier unit 112 and a transducer 110 screws into the rear of the thread 105.

The preamplifier is electrically identical to that described with reference to FIG. 3, but the transducer is a rectangular piezoelectric plate extending parallel to the front surface of the unit 112. The plate is resin bonded to the unit 112 of one end where connection is made between metallizations on opposite sides of the plate and the circuitry of the preamplifier unit. The remainder of the plate is spaced from the unit 112 by a distance sufficiently small to limit inward flexure of the plate to an amount it can withstand without fracture, thus reducing the risk of damage during shipping by movement of an exciter member 118 in the cavity 106 defined within the grille 108. The exciter member is a lighter-than-water plastic ball tethered in front of the transducer by a heavy depending metal stem 119, the base of which sits in the gap remaining between a flange ring 113 in front of the unit 112 and the rear of the grille 108.

The transducer plate is typically 0.08–0.09 inches thick, 0.75 inches long and 0.375 inches wide, is of barium titanate and has a free-air flexural mode resonant frequency of 46 KHz although this will be somewhat modified in water. Mounted as described, such a plate is sufficiently robust to withstand normal handling, and is considerably cheaper than that used in the embodiment of FIGS. 1 and 2.

The principles of operation of this embodiment are exactly the same as have been described with reference to the preceeding embodiment. It should be understood however that all discussion contained herein as to the mode of operation of the devices described is based on the applicant's present understanding thereof and is not to be regarded as limiting the scope of the invention except in so far as it is defined in the appended claims.

What I claim is:

1. A swimming pool alarm comprising a sensor head for suspension in a swimming pool in a position submerged substantially beneath the water surface of the pool, the sensor head comprising an electrical resonator element housed within the head and means maintaining a movable element captive adjacent the resonator element, the movable element being agitatable responsive to movement of the watedr of the pool whereby to promote resonance of the resonator element, and an alarm device external of the pool and responsive to a predetermined amplitude of resonance of the resonator element.

2. A device according to 1, wherein the resonator element is a piezoelectric element.

3. A device according to claim 2, wherein the resonator element is housed in a cavity in the transducer head in free communication with the water of the swimming pool.

4. A device according to claim 3, wherein the cavity is resonant, when filled with water, at a frequency approximately the same as that of the resonator element.

5. A device according to claim 3, wherein the movable element is enclosed in the cavity, the movable element being freely agitatable in response to the movement of water in the cavity.

6. A device according to claim 3, wherein the resonator element is a piezoelectric ceramic disc having one surface forming a wall of the cavity.

7. A device according to claim 3, wherein the resonator element is a piezoelectric ceramic plate anchored at one end to the transducer head.

8. A device according to claim 1, wherein the resonant frequency of the resonator element is 40–200 KHz.

9. A swimming pool alarm comprising a triggerable alarm device, a transducer head incorporatinig a high Q resonator element having an ultrasonic resonant frequency and submersible in a swimming pool, and means sensitive to the amplitude of the resonance of the element and operative to trigger the alarm device, the resonator element being housed in a cavity in the transducer head in free communication with the water of the swimming pool, and a movable element being enclosed in the cavity, the movable element being freely agitatable in response to movement of water in the cavity.

* * * * *